US005609171A

United States Patent [19]

Kuo

[11] Patent Number: 5,609,171

[45] Date of Patent: Mar. 11, 1997

[54] LIPSTICK MOLDING MOLD CLEANING APPARATUS

[76] Inventor: Fu-Chin Kuo, P.O. Box 82-144, Taipei, Taiwan

[21] Appl. No.: 600,733

[22] Filed: Feb. 13, 1996

[51] Int. Cl.[6] ..... B08B 9/02

[52] U.S. Cl. ..... 134/56 R; 134/57 R; 134/166 R; 134/153; 134/201

[58] Field of Search ..... 134/56 R, 57 R, 134/58 R, 155, 186, 166 R, 168 R, 169 R, 153

[56] References Cited

U.S. PATENT DOCUMENTS

| | | | |
|---|---|---|---|
| 4,119,108 | 10/1978 | Alexander | 134/142 |
| 4,688,586 | 8/1987 | Weis et al. | 134/80 |
| 5,078,164 | 1/1992 | Doelgast | 134/166 R |
| 5,186,760 | 2/1993 | Rubenzer | 134/169 R |
| 5,346,502 | 9/1993 | Matthews et al. | 134/169 R |
| 5,366,562 | 11/1994 | Schwarze et al. | 134/169 R |

*Primary Examiner*—Frankie L. Stinson
*Attorney, Agent, or Firm*—Alfred Lei

[57] ABSTRACT

A lipstick molding mold cleaning apparatus including a water level controller to automatically control the level of water in a washing tank, a plurality of sensors to detect the position of the lipstick molding mold under cleaning, and sets of nozzles controlled by the sensors to respectively wash the lipstick molding mold with washing water, clean the lipstick molding mold with detergent, rinse the lipstick molding mold with rinsing water, and dry the lipstick molding mold with air.

6 Claims, 7 Drawing Sheets

LIPSTICK MOLDING MOLD CLEANING APPARATUS

BACKGROUND OF THE INVENTION

1. Field of the Invention

This invention relates to a lipstick molding mold cleaning apparatus which includes sets of nozzles controlled by respective sensors to respectively wash the lipstick molding mold with washing water, clean the lipstick molding mold with detergent, rinse the lipstick molding mold with rinsing water, and dry the lipstick molding mold with air.

2. Description of the Prior Art

The lipstick molding mold of a lipstick fabrication machine must be cleaned after each molding process. If the mold is not well cleaned, residual cosmetic paste will be left in the cells of the mold. Conventionally, this cleaning work is done by labor. However, cleaning the lipstick molding mold of a lipstick fabrication machine by labor takes much working time, and the surface of mold tends to be damaged.

SUMMARY OF THE INVENTION

This invention relates to a lipstick molding mold cleaning apparatus.

It is one object of the present invention to provide a lipstick molding mold cleaning apparatus which automatically cleans the lipstick molding mold. It is another object of the present invention to provide a lipstick molding mold cleaning apparatus which saves the consumption of washing water.

According to the preferred embodiment of the present invention, the lipstick molding mold cleaning apparatus comprises a washing tank, a water level controller to automatically control the level of water in the washing tank, a plurality of sensors to detect the position of the lipstick molding mold under cleaning, and sets of nozzles controlled by the sensors to respectively wash the lipstick molding mold with washing water, clean the lipstick molding mold with detergent, rinse the lipstick molding mold with rinsing water, and dry the lipstick molding mold with air.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
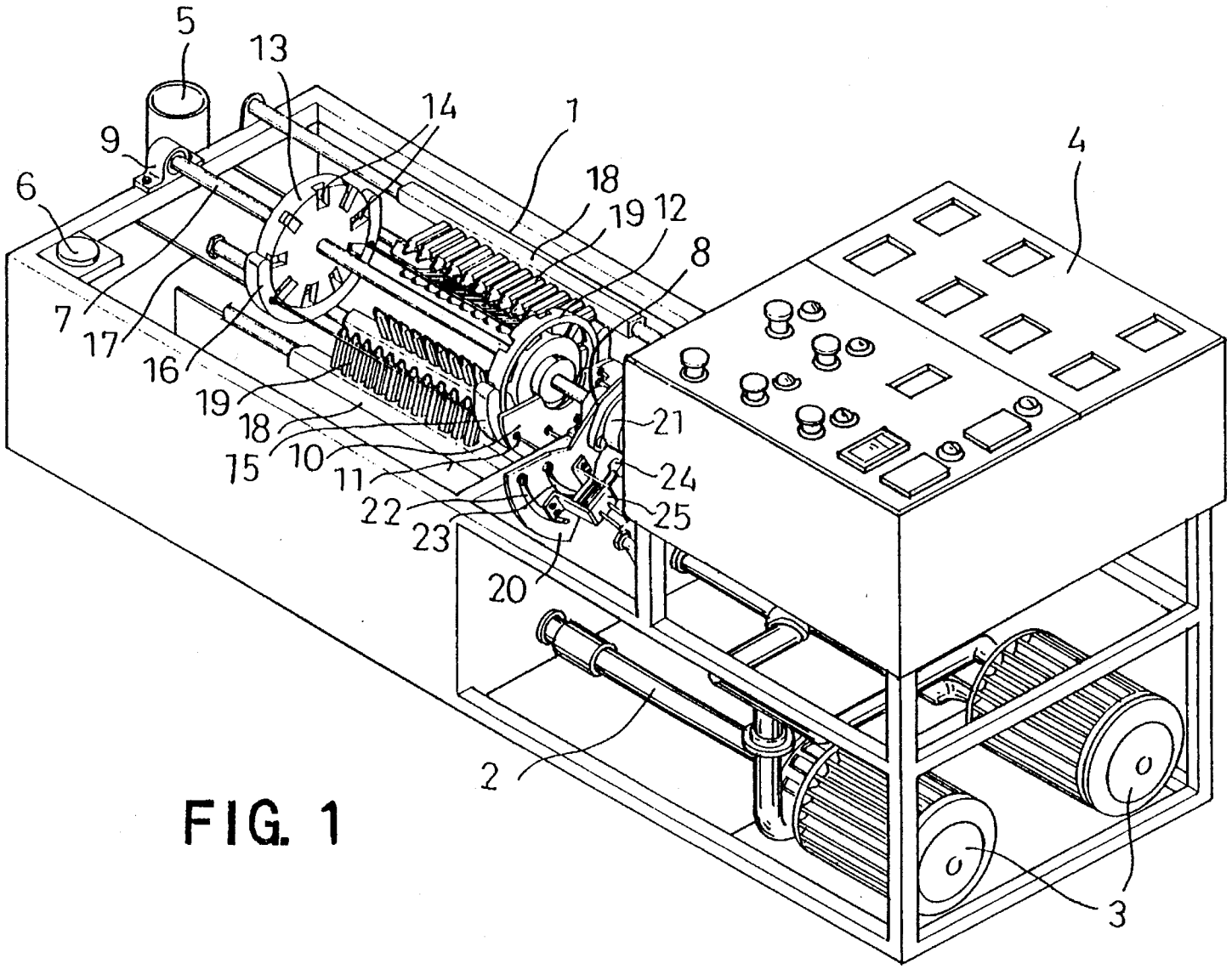
FIG. 1 is an elevational view of a lipstick molding mold cleaning apparatus according to the preferred embodiment of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIG. 1, a lipstick molding mold cleaning apparatus in accordance with the present invention is generally comprised of a washing tank unit 1, a set of motor pumps 3 controlled to pump water in and out of the washing tank unit 1, a water supply pipe system 2 connected between the washing tank unit 1 and the set of motor pumps 3, a control box 4 above the set of water circulation control motors 3, a detergent filling trough 5 at the back side of the washing tank unit 1, and a water level controller 6, which detects the level of water in the washing tank unit i and controlled the operation of the water circulation control motors 3 subject to the level of water in the washing tank unit 1.

Figure 2:
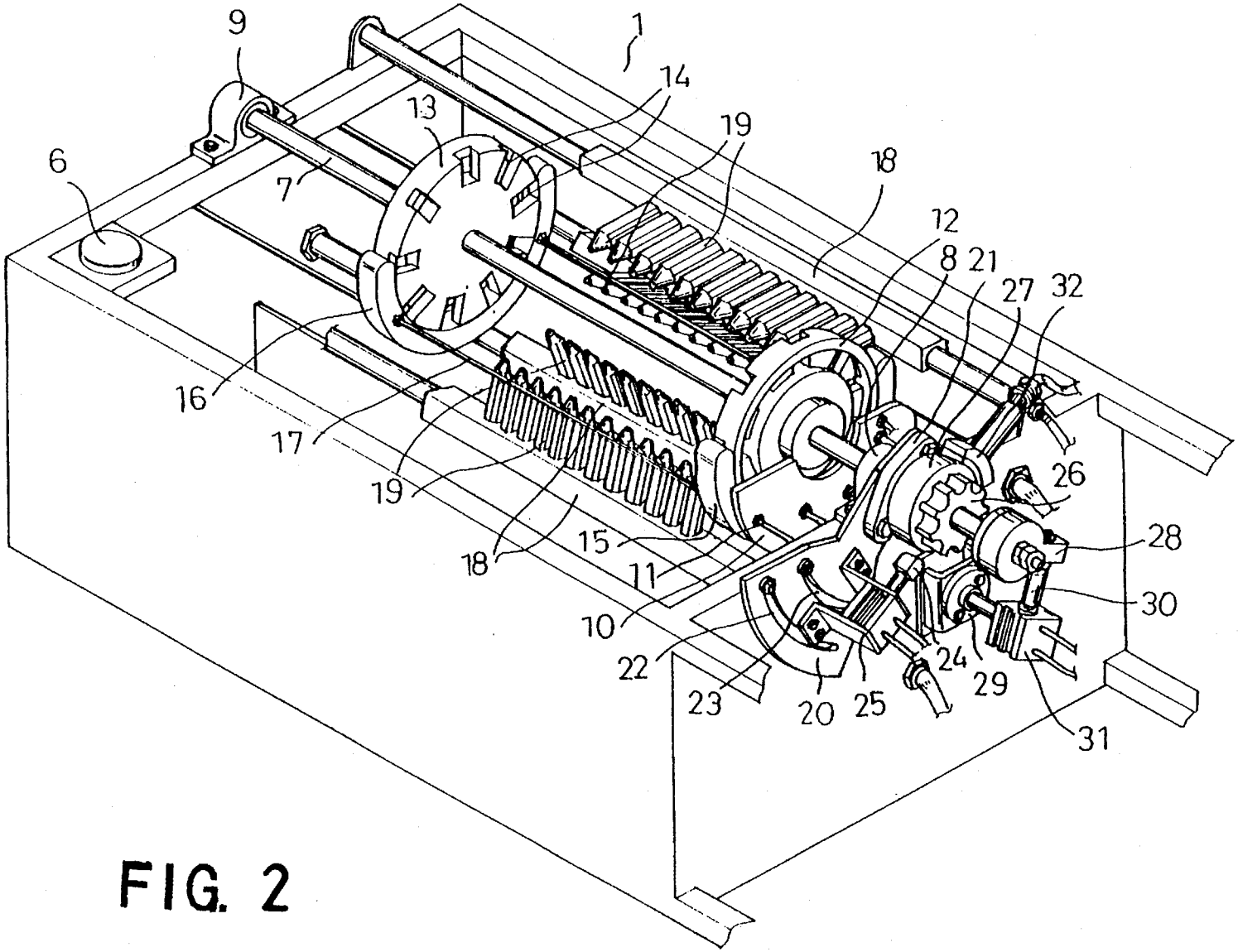
FIG. 2 is an elevational view of the washing tank unit of the lipstick molding mold cleaning apparatus shown in FIG. 1.
Figure 3:
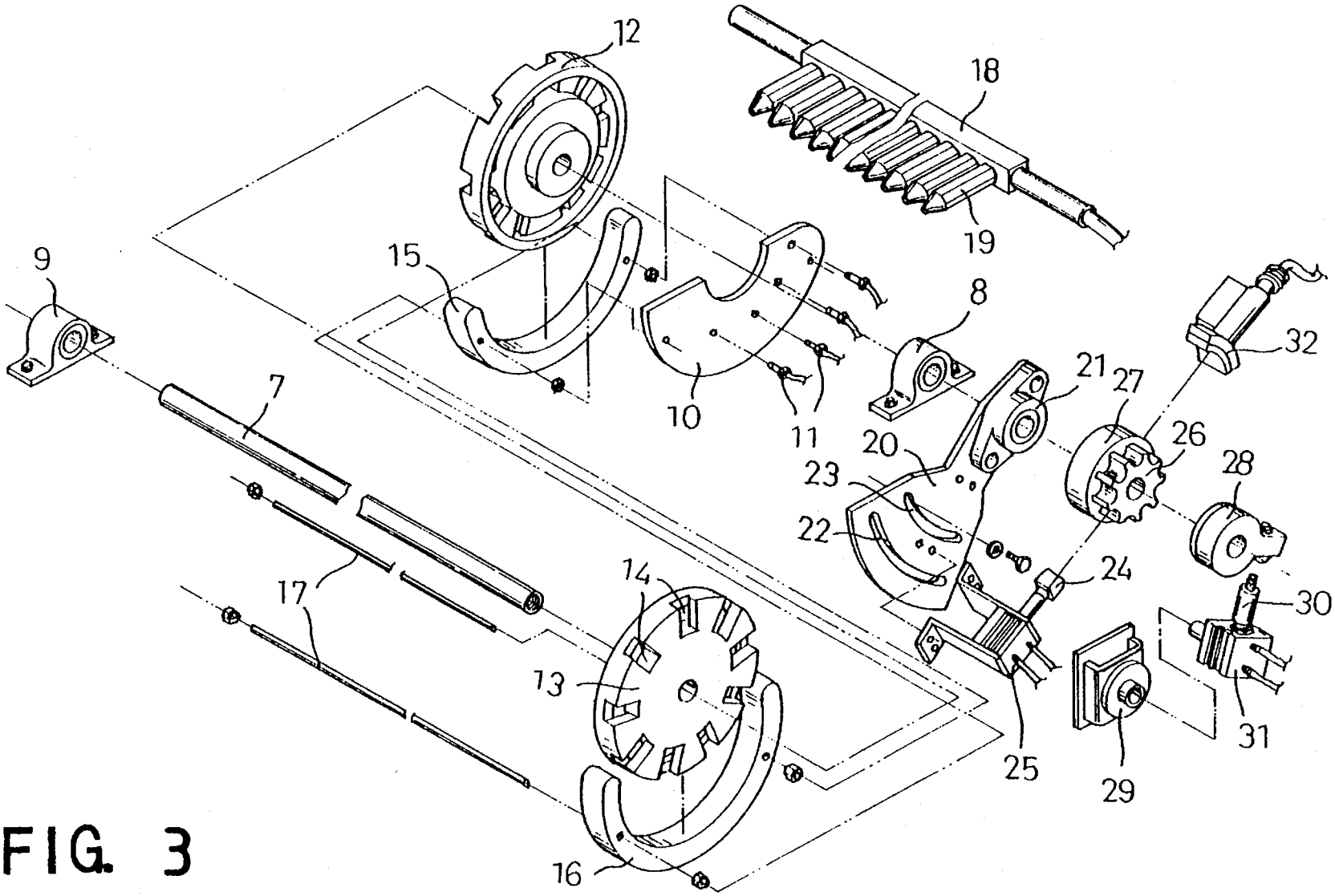
FIG. 3 is an exploded view of the internal mechanical mechanism of the washing tank unit shown in FIG. 2.

Referring to FIGS. 2 and 3, the washing tank unit 1 comprises a center shaft 7 longitudinally disposed at the top in the middle and supported between two opposite axle bearings, namely, the front axle bearing 8 and the rear axle bearing 9, a smoothly arched sensor holder 10 is disposed behind the front axle bearing 8 to hold four photoelectric sensors 11, a front locating wheel 12 and a rear locating wheel 13 respectively mounted around the center shaft 7 and spaced between the sensor holder 10 and the rear axle bearing 9 for holding the lipstick mold, two longitudinal locating rods 17 bilaterally disposed below the center shaft 7, a smoothly arched front locating plate 15 and a smoothly arched rear locating plate 16 mounted on the locating rods 17 and respectively attached to the periphery of the front locating wheel 12 and the rear locating wheel 13 at the bottom for holding the lipstick mold, four nozzle holders 18 spaced around the center shaft 7 between the front locating wheel 12 and the rear locating wheel 13 to hold a respective row of nozzles 19, which face the center shaft 7, an oscillating sector plate 20 mounted around the center shaft 7 in front of the front locating wheel 12, which has a bearing block 21 mounted around the center shaft 7, a first arched slot 22 and a second arched slot 23 spaced from the bearing block 21 at different distances, a first hydraulic cylinder 25 fixedly secured to the oscillating sector plate 20 and bridged over the second arched slot 23, a rotating barrel 27 mounted around the bearing block 21, a ratchet wheel 26 fixedly secured to the rotating barrel 27, an one-way bearing 28 fixedly mounted around the center shaft 7 and disposed adjacent to the ratchet wheel 26, a cylinder holder 29 disposed below the center shaft 7 adjacent to the oscillating sector plate 20, a second hydraulic cylinder 31 mounted on the cylinder holder 29, and a friction member 32 stopped against the periphery of the rotating barrel 27, wherein, each of the locating wheels 12, 13 defines a plurality of equiangularly spaced radial recesses 14 at an outer side; the first hydraulic cylinder 25 is controlled to reciprocate a piston rod 24 relative to the ratchet wheel 26; the second hydraulic cylinder 31 is controlled to reciprocate a piston rod 30 relative to the one-way bearing 28.

Figure 4A:
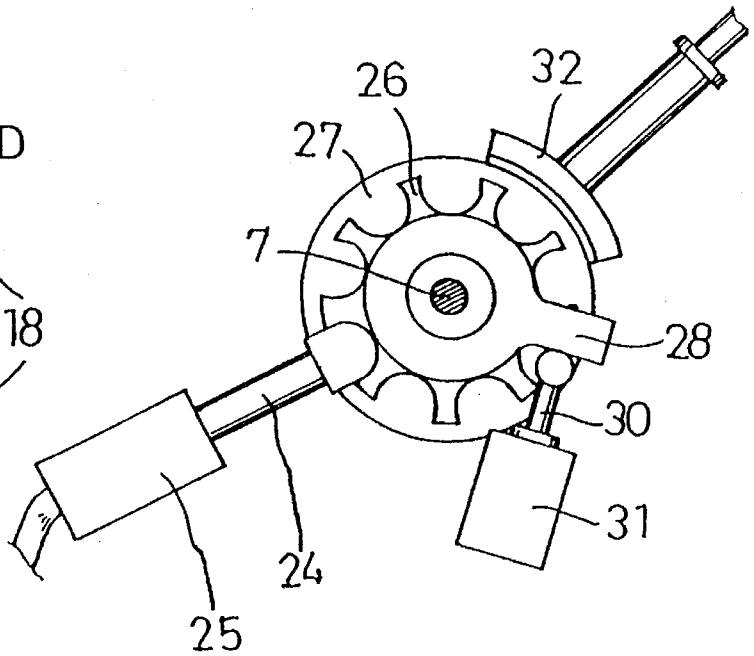
FIG. 4A is a schematic drawing showing the piston of the second hydraulic cylinder retracted, and the piston of the first hydraulic cylinder forced into engagement with the ratchet wheel.

Referring to FIG. 4A, the piston rod 30 of the second hydraulic cylinder 31 is stopped at the one-way bearing 28, the piston rod 24 of the first hydraulic cylinder 25 is forced into engagement with the ratchet wheel 26, the friction member 32 is stopped at the periphery of the rotating barrel 27, and the center shaft 7 is stopped from rotation.

Figure 4B:
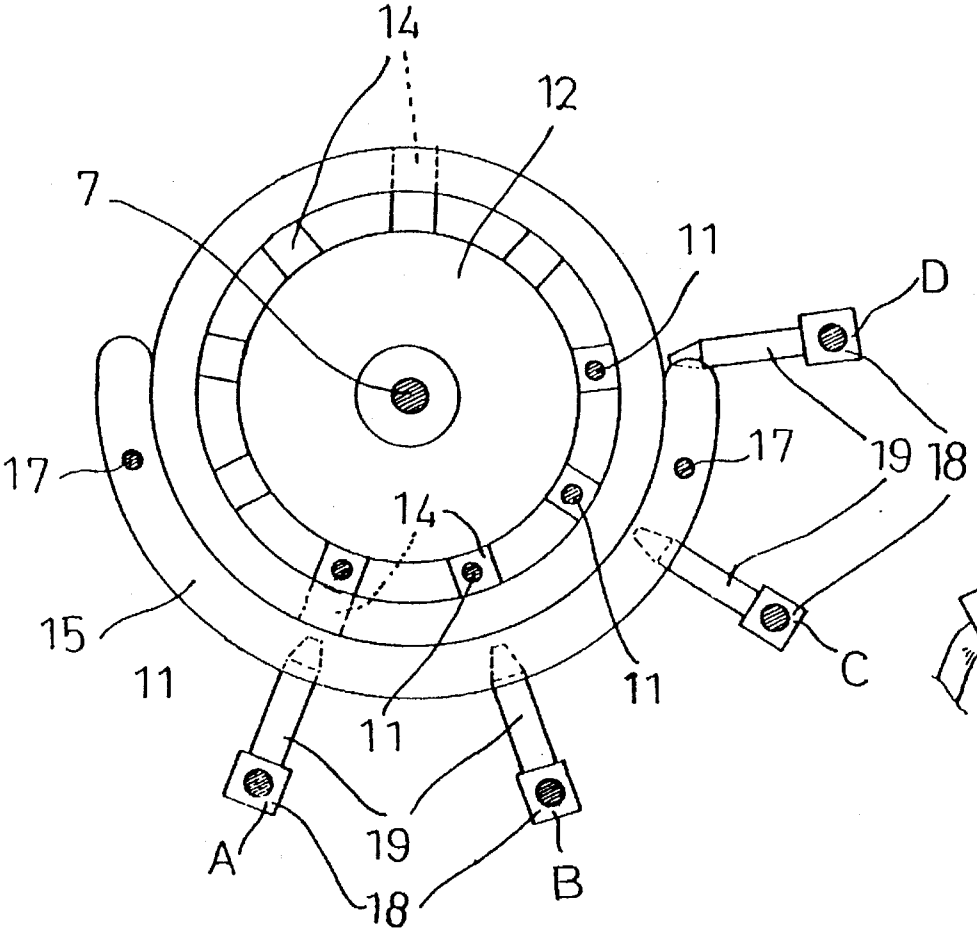

Referring to FIG. 4B, the four rows of nozzles 19 are arranged at four different positions A, B, C, D respectively spaced from one another in proper order in the counter-clockwise direction and operated for different purposes, i.e., the nozzles 19 at the position A are controlled to wash the lipstick mold with washing water, the nozzles 19 at the position B are controlled to clean the lipstick mold with detergent, the nozzles 19 at the position C are controlled to rinse the lipstick mold with rinsing water, and the nozzles 19 at the position D are controlled to dry the well washed lipstick mold with air; the photoelectric sensors 11 are set at positions relative to the four rows of nozzles 19 and controlled to detect the presence of the lipstick mold at the respective position A, B, C or D.

Figure 5A:
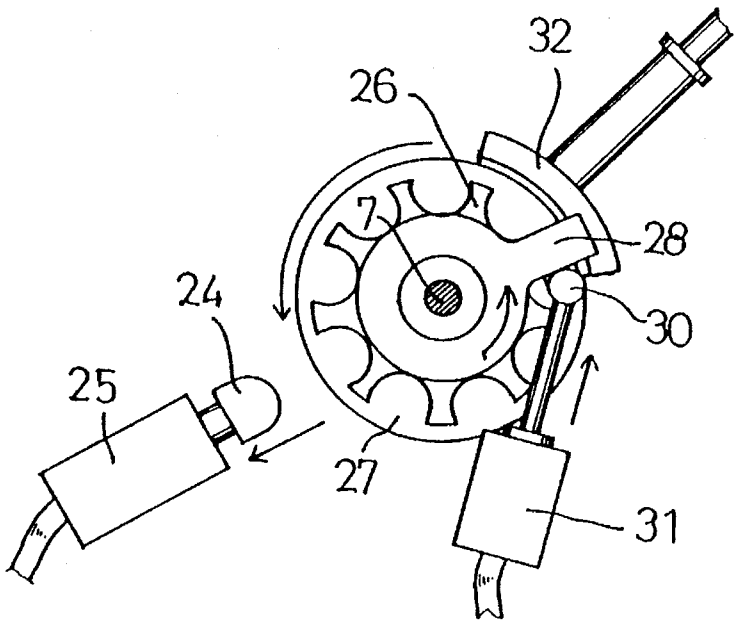
FIG. 5B is a schematic drawing showing the locating wheels turned, and the lipstick molding mold moved from the position A to the position B.
Figure 5B:
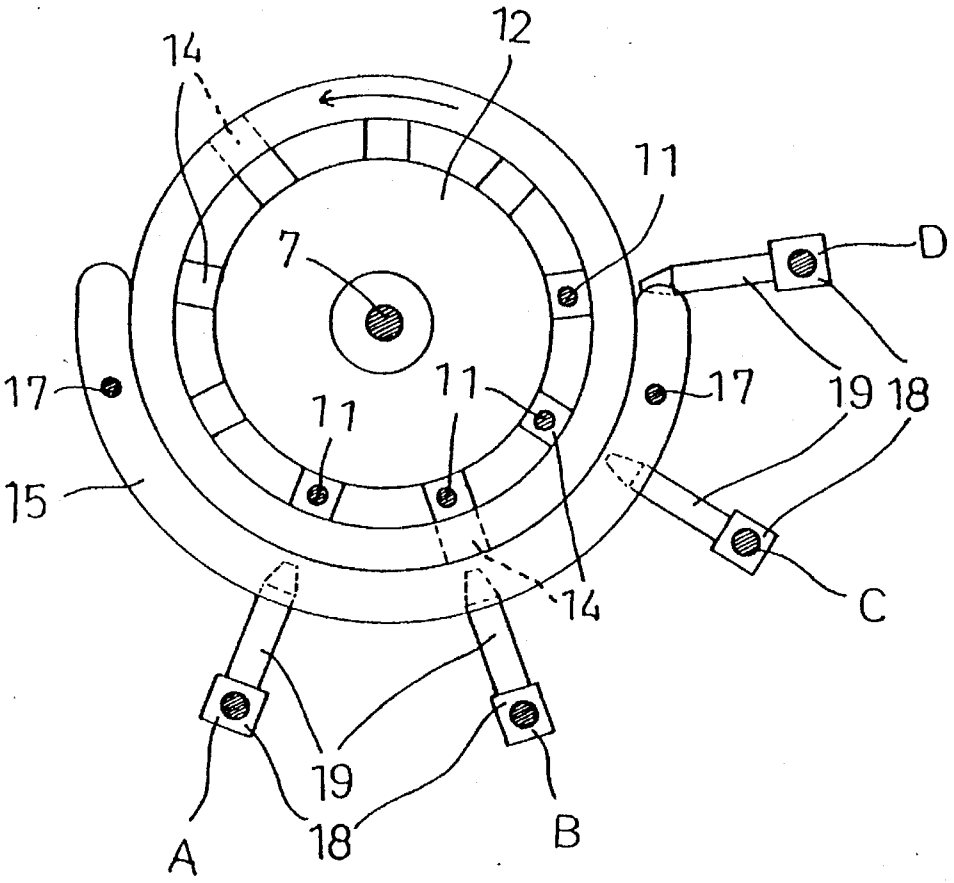
Figure 6A:
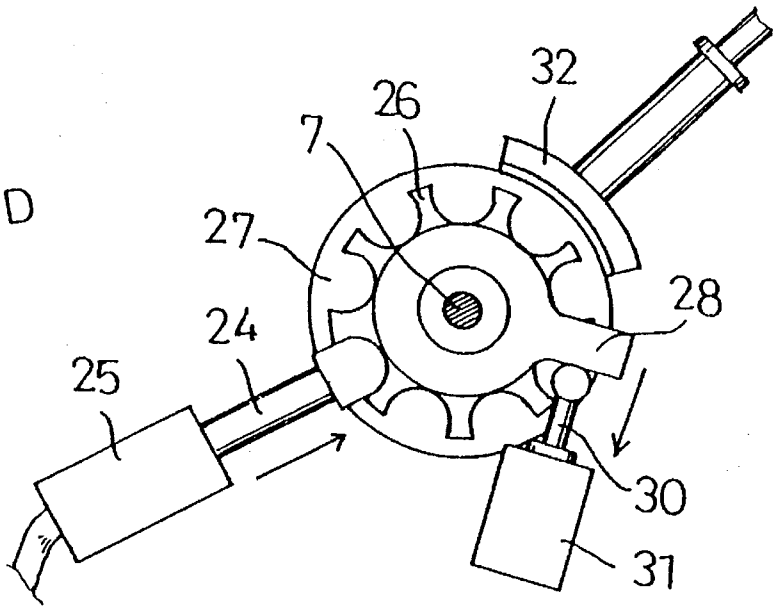
FIG. 6A is a schematic drawing showing the piston of the second hydraulic cylinder extended out, the one-way bearing turned, and the piston of the first hydraulic cylinder retracted.
Figure 6B:
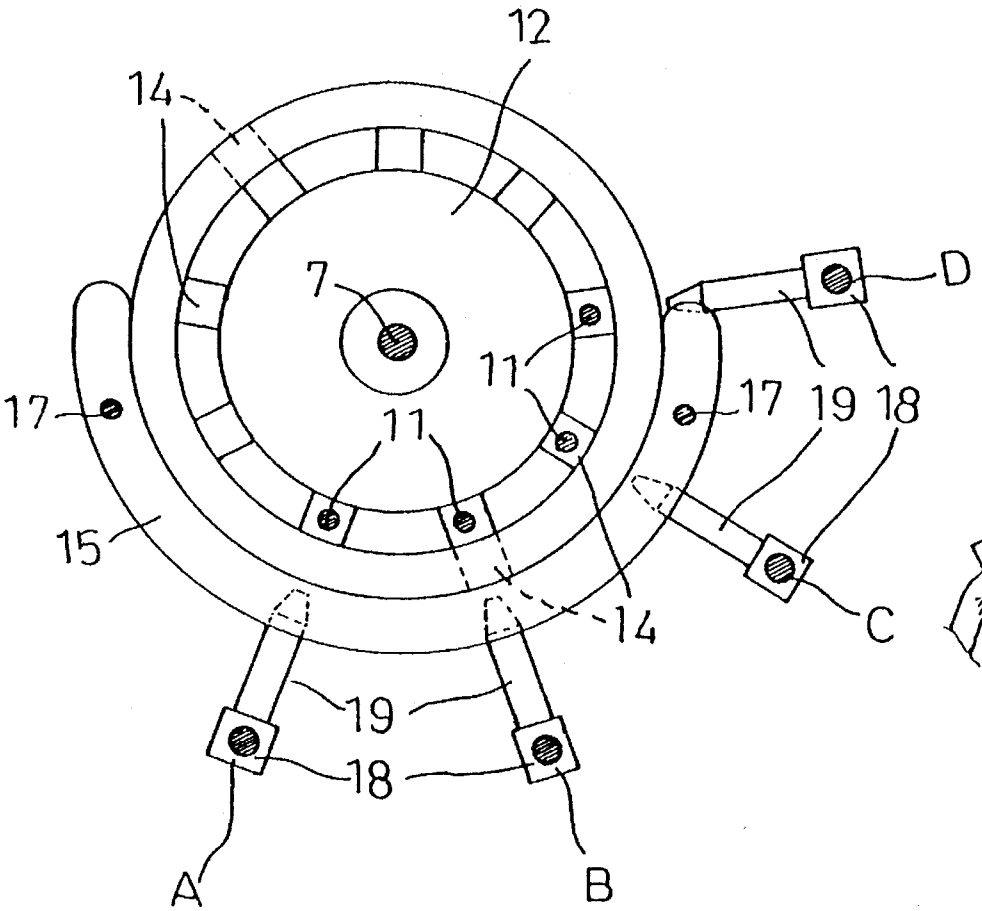
FIG. 6B is a schematic drawing showing the locating wheels retained at the position B.

Referring to FIGS. 5A, 5B, 6A, and 6B, when the piston rod 30 of the second hydraulic cylinder 31 is extended out to turn the one-way bearing 28 in the counter-clockwise direction, the center shaft 7 is turned with the one-way bearing 28 in the counter-clockwise direction, and the same time the piston rod 24 of the first hydraulic cylinder 25 is retracted (see FIG. 5A, and therefore the lipstick mold is moved from the position A to the locating B. When the lipstick mold is moved away from the position A to the position B, the respective photoelectric sensor 11 stops the nozzles 19 at the position A from working (see FIG. 5B). When the lipstick mold is moved to the position B, the corresponding photoelectric sensor 11 drives the nozzles 19 at the position B are controlled to eject detergent toward the lipstick mold, and at the same time the second hydraulic cylinder 31 is driven by the corresponding photoelectric sensor 11 to retract the respective piston rod 30 and the first hydraulic cylinder 25 is driven to force the respective piston 24 into engagement with the ratchet wheel 26 (see FIGS. 6A and 6B). The friction member 32 is designed to slow down the turning speed of the rotating barrel 27.

Figure 7B:
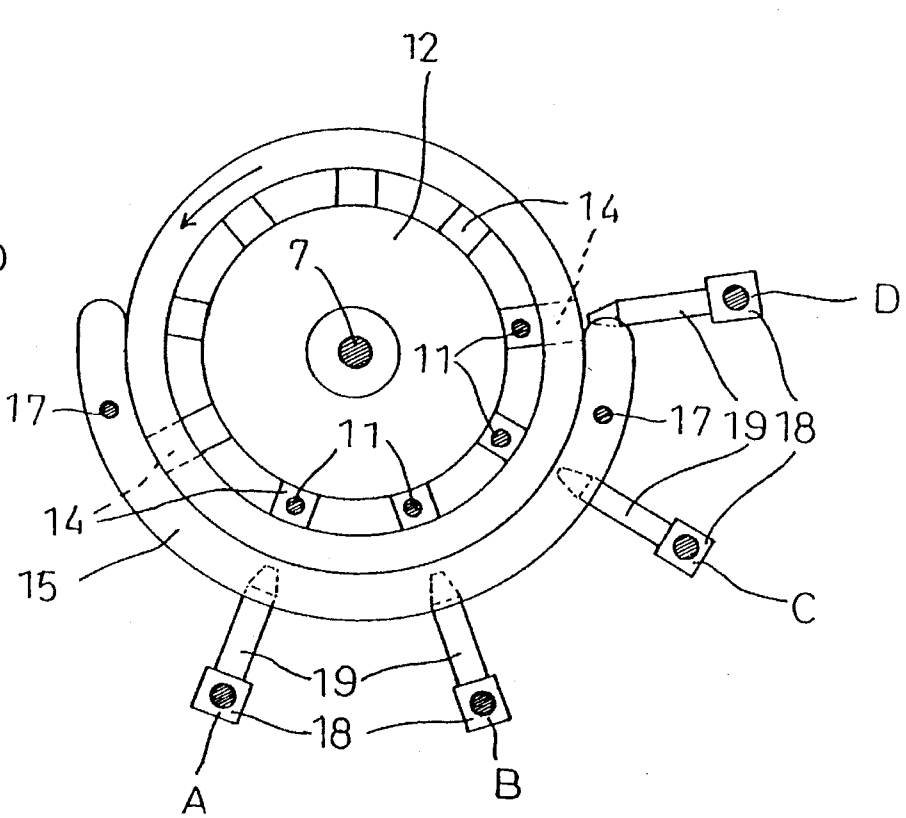
FIG. 7B is a schematic drawing showing the locating wheels turned from the position C to the position D.
Figure 7A:
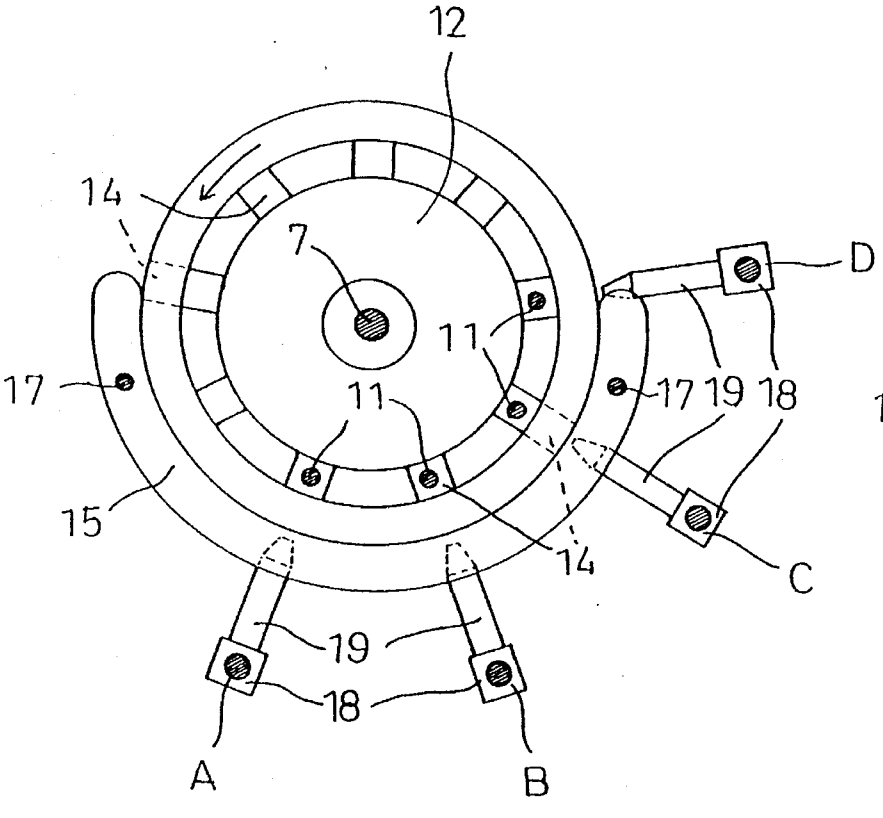
FIG. 7A is a schematic drawing showing the locating wheels turned from the position B to the position C.

FIG. 7A shows the lipstick mold moved to the position C for rinsing. FIG. 7B shows the lipstick mold moved to the position D for air-drying. The length of operating time at each position can be set as desired, and achieved by means of controlling the operation of the hydraulic cylinders 25, 31.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A lipstick molding mold cleaning apparatus, comprising a washing tank unit, a set of motor pumps controlled to pump water in and out of said washing tank unit, a water supply pipe system connected between said washing tank unit and said set of motor pumps, a control box for controlling the operation of the apparatus, a detergent filling trough, and a water level controller, which detects the level of water in said washing tank and control the operation of said water circulation control motors subject to the level of water in said washing tank unit, wherein said washing tank unit comprises a longitudinal center shaft supported between a front axle bearing and a rear axle bearing, a smoothly arched sensor holder disposed behind said front axle bearing, four sensors respectively mounted in said smoothed arched sensor holders sensors at four different positions around said longitudinal center shaft to detect the presence of the lipstick molding mold under washing, a front locating wheel and a rear locating wheel respectively mounted around said center shaft and spaced between said sensor holder and said rear axle bearing to hold said lipstick molding mold at one of said four different positions, two longitudinal locating rods bilaterally disposed below said longitudinal center shaft, a smoothly arched front locating plate and a smoothly arched rear locating plate mounted on said locating rods and respectively attached to the periphery of said front locating wheel and said rear locating wheel at a bottom side to hold said lipstick molding plate in place, four nozzle holders spaced around said longitudinal center shaft between said front locating wheel and said rear locating wheel corresponding to the four different positions of said sensors, four sets of nozzles respectively installed in said four nozzle holders, an oscillating sector plate mounted around said longitudinal center shaft in front of said front locating wheel, said oscillating sector plate having a bearing block mounted around said longitudinal center shaft, a first arched slot and a second arched slot spaced from said bearing block at different distances, a first hydraulic cylinder fixedly secured to said oscillating sector plate and bridged over said second arched slot and controlled to stop said ratchet wheel from rotation, a rotating barrel mounted around said bearing block, a ratchet wheel fixedly secured to said rotating barrel, an one-way bearing fixedly mounted around said longitudinal center shaft adjacent to said ratchet wheel, a cylinder holder disposed below said longitudinal center shaft adjacent to said oscillating sector plate, a second hydraulic cylinder mounted on said cylinder holder and controlled to turn said one-way bearing and said longitudinal center shaft, and a friction member stopped against the periphery of said said rotating barrel, said first hydraulic cylinder having a piston rod moved relative to said ratchet wheel, said second hydraulic cylinder having a piston rod reciprocated relative to said one-way bearing, said front locating wheel and said rear locating wheel being turned by said longitudinal center shaft to move said lipstick molding mold between said four different positions upon the rotary motion of said one-way bearing.

2. The lipstick molding mold cleaning apparatus as claimed in claim 1 wherein said sensors are ultrasonic sensors.

3. The lipstick molding mold cleaning apparatus as claimed in claim 1 wherein said sensors are photoelectric sensors.

4. The lipstick molding mold cleaning apparatus as claimed in claim 1 wherein said water level controller can be a float controlled water level controller, auto-balance type water level controller, pressure difference-activated water level controller, water pressure-activated water level controller, or electromagnetic water level controller.

5. The lipstick molding mold cleaning apparatus as claimed in claim 1 wherein said four sets of nozzles are respectively controlled to wash said lipstick molding mold with washing water, to clean said lipstick molding mold with detergent, to rinse said lipstick molding mold with rinsing water, and to dry said lipstick molding mold with air.

6. The lipstick molding mold cleaning apparatus as claimed in claim 1 wherein said set of motor pumps includes at least one motor pump controlled to pump water into said washing tank unit, and at least one motor pump controlled to pump water out of said washing tank unit.

* * * * *